US008814995B2

(12) United States Patent
Johansson et al.

(10) Patent No.: US 8,814,995 B2
(45) Date of Patent: Aug. 26, 2014

(54) ELECTRICAL SCREENING DEVICE FOR STRUCTURES NEAR HIGH VOLTAGE PARTS OF ELECTROSTATIC PRECIPITATORS

(71) Applicant: ALSTOM Technology Ltd, Baden (CH)

(72) Inventors: Per Bengt Daniel Johansson, Växjö (SE); Andreas Olof Back, Växjö (SE)

(73) Assignee: ALSTOM Technology Ltd, Baden (CH)

( * ) Notice: Subject to any disclaimer, the term of this patent is extended or adjusted under 35 U.S.C. 154(b) by 0 days.

(21) Appl. No.: 13/929,145

(22) Filed: Jun. 27, 2013

(65) Prior Publication Data

US 2013/0284025 A1 Oct. 31, 2013

Related U.S. Application Data

(63) Continuation of application No. PCT/IB2011/003043, filed on Dec. 13, 2011.

(30) Foreign Application Priority Data

Dec. 29, 2010 (EP) ..... 10197252

(51) Int. Cl.
*B03C 3/47* (2006.01)
*B03C 3/70* (2006.01)

(52) U.S. Cl.
CPC .... *B03C 3/47* (2013.01); *B03C 3/70* (2013.01)
USPC ..... 96/79; 96/83; 96/86; 96/87; 96/88; 96/92

(58) Field of Classification Search
USPC ..... 96/78, 79, 83, 86–88, 92
See application file for complete search history.

(56) References Cited

U.S. PATENT DOCUMENTS

| | | | | | |
|---|---|---|---|---|---|
| 2,542,262 | A | * | 2/1951 | Richardson | 96/86 |
| 3,175,341 | A | * | 3/1965 | Winter | 96/86 |
| 3,729,815 | A | * | 5/1973 | Quintilian et al. | 29/592.1 |
| 4,167,400 | A | * | 9/1979 | Onushco | 96/88 |
| 4,233,037 | A | | 11/1980 | Pontius et al. | |
| 4,508,547 | A | * | 4/1985 | Seufert | 96/92 |
| 4,559,064 | A | * | 12/1985 | Ahern | 96/87 |
| 4,725,289 | A | | 2/1988 | Quintilian | |
| 4,948,399 | A | * | 8/1990 | Reuffurth et al. | 96/92 |

(Continued)

FOREIGN PATENT DOCUMENTS

| | | |
|---|---|---|
| DE | 19 01 981 | 8/1970 |
| DE | 33 24 888 | 1/1985 |

(Continued)

*Primary Examiner* — Duane Smith
*Assistant Examiner* — Sonji Turner

(57) ABSTRACT

An electrostatic precipitator having a collecting electrode plate assembly, including at least two electrode plates disposed substantially in a parallel to each other in the vertical plane within the electrostatic precipitator, forming a space between the collecting electrode plates, and a discharge electrode assembly interposed in said spaces, wherein the electrode assembly passing at least a supporting structure of the collecting electrode plate assembly. The supporting structure is provided with an electrical screening device at least in the area of the supporting structure facing said electrode assembly.

9 Claims, 6 Drawing Sheets

(56) References Cited

U.S. PATENT DOCUMENTS

| | | | | | |
|---|---|---|---|---|---|
| 5,366,540 | A | * | 11/1994 | Bojsen | 96/33 |
| 5,421,863 | A | * | 6/1995 | Rector et al. | 96/60 |
| 5,584,915 | A | * | 12/1996 | Broughton | 96/32 |
| 5,665,147 | A | * | 9/1997 | Taylor et al. | 96/72 |
| 6,048,385 | A | * | 4/2000 | Koide | 96/83 |
| 6,096,119 | A | * | 8/2000 | Ho et al. | 96/79 |
| 6,156,104 | A | * | 12/2000 | Jeong | 96/88 |
| 6,579,349 | B1 | * | 6/2003 | Ting et al. | 96/44 |
| 7,901,489 | B2 | * | 3/2011 | Jin et al. | 96/30 |
| 2009/0235821 | A1 | * | 9/2009 | Mochizuki et al. | 96/83 |

FOREIGN PATENT DOCUMENTS

| | | | | | |
|---|---|---|---|---|---|
| JP | 4-322757 | A | * | 11/1992 | 96/87 |
| JP | 2008-023490 | | | 2/2008 | |
| WO | 2010/061327 | | | 6/2010 | |

* cited by examiner

ELECTRICAL SCREENING DEVICE FOR STRUCTURES NEAR HIGH VOLTAGE PARTS OF ELECTROSTATIC PRECIPITATORS

This is a continuation of International Application No. PCT/IB2011/003043 having an International Filing Date of Dec. 13, 2011, incorperated herein in its entirety by reference.

FIELD OF THE INVENTION

This invention relates to an electrostatic precipitator having a collecting electrode plate assembly, including at least two electrode plates disposed substantially in a parallel to each other in the vertical plane within the electrostatic precipitator, forming a space between the collecting electrode plates, and a discharge electrode assembly interposed in said spaces, wherein the electrode assembly passing at least a supporting structure of the collecting electrode plate assembly.

BACKGROUND ART

Electrostatic precipitators are well known in the prior art and as an example U.S. Pat. No. 4,725,289 disclose a rigid-frame type electrostatic precipitator. In the operation of an electrostatic precipitator, a gas laden with entrained particulate material is passed through an electrostatic field and corona discharge established about a discharge electrode disposed between two grounded collecting electrodes. The particles in the gas become electrically charged as they pass through the corona discharge and move to, under the influence of the electrostatic field, and deposit upon the grounded collecting electrodes flanking the discharge electrode.

Typically, each collecting electrode is formed of one or more elongated plates disposed in a row side by side and suspended from the top of the precipitator housing in a vertical plane. A plurality of such collecting electrodes is disposed transversely across the width of the precipitator casing in spaced vertical planes parallel to the direction of the gas flow through the precipitator.

In what is commonly referred to as a rigid-frame electrostatic precipitator, a framework comprised of a plurality of discharge electrode frames is suspended from insulators at the top of the precipitator housing to provide a row of vertically disposed discharge electrodes between adjacent collecting electrodes across the width of the precipitator. A voltage is applied to the discharge electrodes to generate the corona discharge and associated electrostatic field.

An electrostatic precipitator design in which discharge frame pipe passes the grounded collecting electrode support beam in the top of the electrostatic precipitators is previously known. The support beam is normally formed of an I-beam or U-beam. However, due to sparking between structural parts the power input to the electrostatic precipitator has become low. In the prior art the I-beam or U-beam has been provided with local cut-outs to increase the distance between the discharge pipe and the beam. Such cut-outs have been found insufficient in recent high voltage testing and spark-over has occurred despite the cut-outs.

SUMMARY OF THE INVENTION

An object of the present invention is to provide an electrical screening device for structures near high voltage parts of electrostatic precipitators.

The above object is achieved by the introductory described electrostatic precipitator which is characterized in that the supporting structure is provided with an electrical screening device at least in the area of the supporting structure facing said electrode assembly. By the electrical screening device a spark-over is more or less eliminated in said area.

Preferably, the electrical screening device has an essentially rounded or arched shape. Thereby, eliminating sharp edges having tendency of forming points where spark-over may occur. The rounded or arched shape may, for example, have a radius of 15 to 100 mm.

In one embodiment, the electrical screening device is integrated with the supporting structure. By this the problem may be solved at the dimensioning of the support structure.

In another embodiment, the electrical screening device is attached to the supporting structure. This solves the problem also at an existing support structure.

In a preferred embodiment the electrical screening device having a longitudinal shape and being formed of at least a half-pipe arranged with the outer surface facing said electrode assembly. By this a simple and economic screening device may be arranged both on existing or new support structures.

In another embodiment, at least one electrical screening device is integrally connected with a bracket attached to the supporting structure. Hereby, facilitating the attachment to the supporting structure.

BRIEF DESCRIPTION OF THE DRAWINGS

The invention will in the following be described in more detail with reference to the accompanying schematic drawings which by way of example illustrate preferred embodiments of the invention.

DETAILED DESCRIPTION OF A PREFERRED EMBODIMENT

An electrostatic precipitator having generally a housing (not shown) with an inlet (not shown), an outlet (not shown) and a precipitation chamber disposed therebetween. The particulate laden flue gas to be cleaned passes through the housing (not shown) of the precipitator passing from the gas inlet through the precipitation chamber and to the gas outlet as a clean, relatively particulate free gas.

Figure 1:
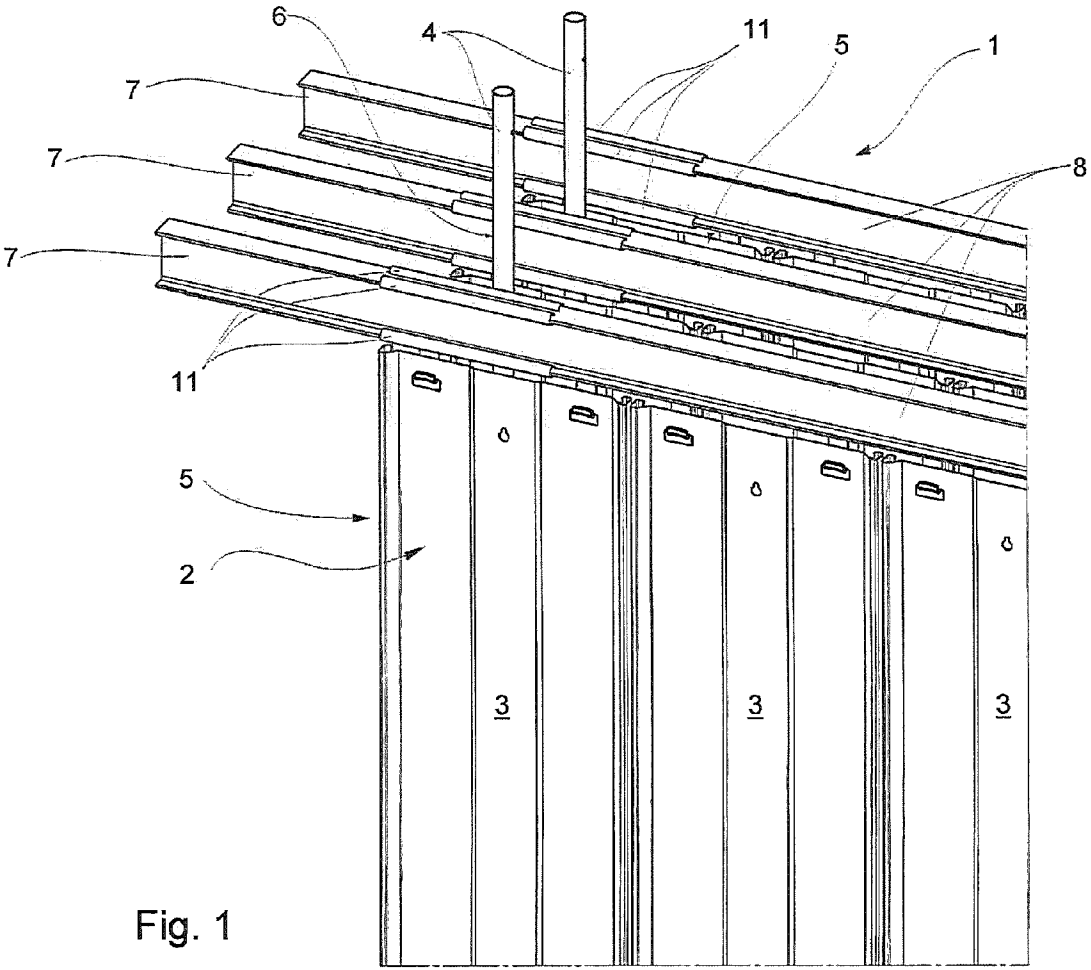
FIG. 1 is a schematic view in perspective partly illustrating an upper part of the electrostatic precipitator in accordance with the preferred embodiment.
Figure 4:
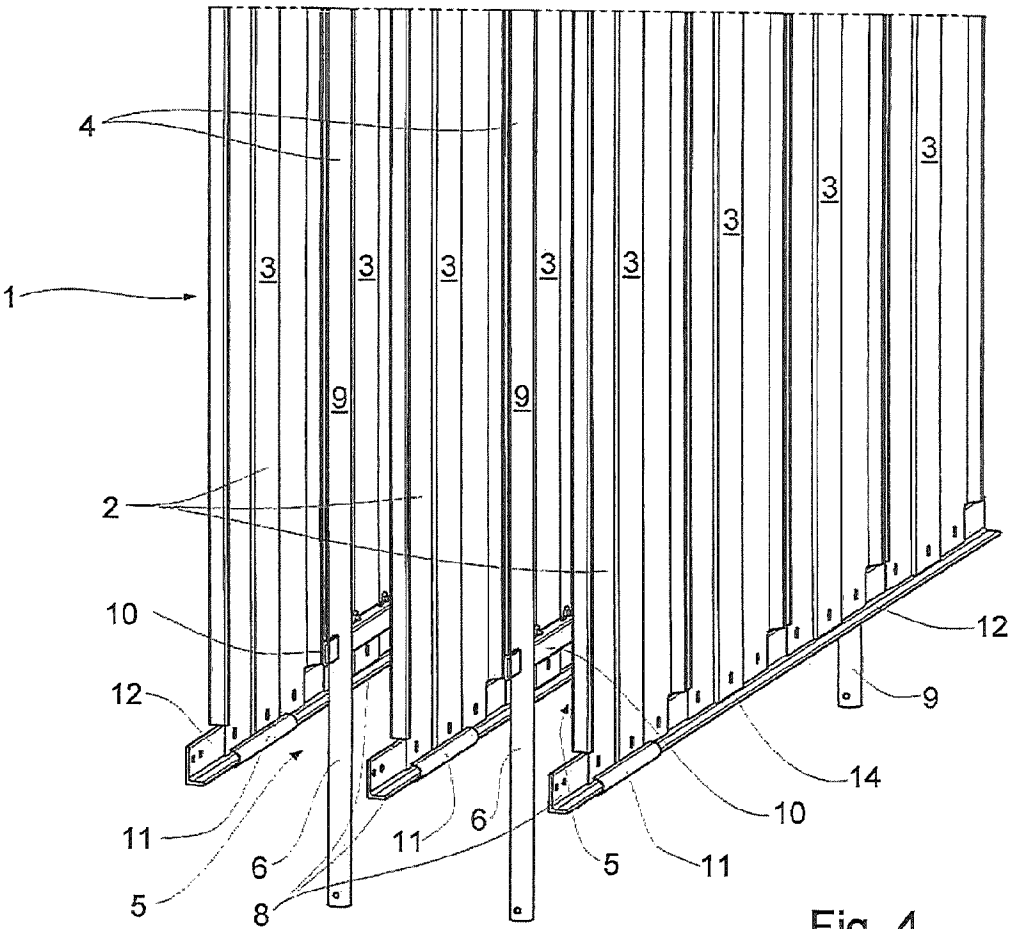
FIG. 4 is a schematic view in perspective partly illustrating a lower part of the electrostatic precipitator in accordance with the preferred embodiment.

Referring now to the drawings, and most particularly to FIGS. 1 and 4, the basic configuration of an electrostatic precipitator 1 is depicted therein, and is typically referred to as a rigid frame-type electrostatic precipitator. A grounded supporting structure 8 including upper support beams 7 and lower support beams 12 carries a plurality of substantially rectangular collecting electrode plates 3, forming collectively a collecting electrode plate assembly 2, are disposed in substantially parallel, spaced relationship in vertical planes within the electrostatic precipitator 1. Thereby, forming a space 5 between each pair of collecting electrode plates 3. Interposed in the spaces 5 between the collecting electrode plates 3 are a plurality of discharge electrode frames 6 which collectively form a discharge electrode assembly 4. Both the collecting electrode plates 3 and the discharge electrode frames 6 are aligned parallel to and extend in the direction of gas flow through the electrostatic precipitator 1, from the inlet to the outlet thereof.

Figure 6:
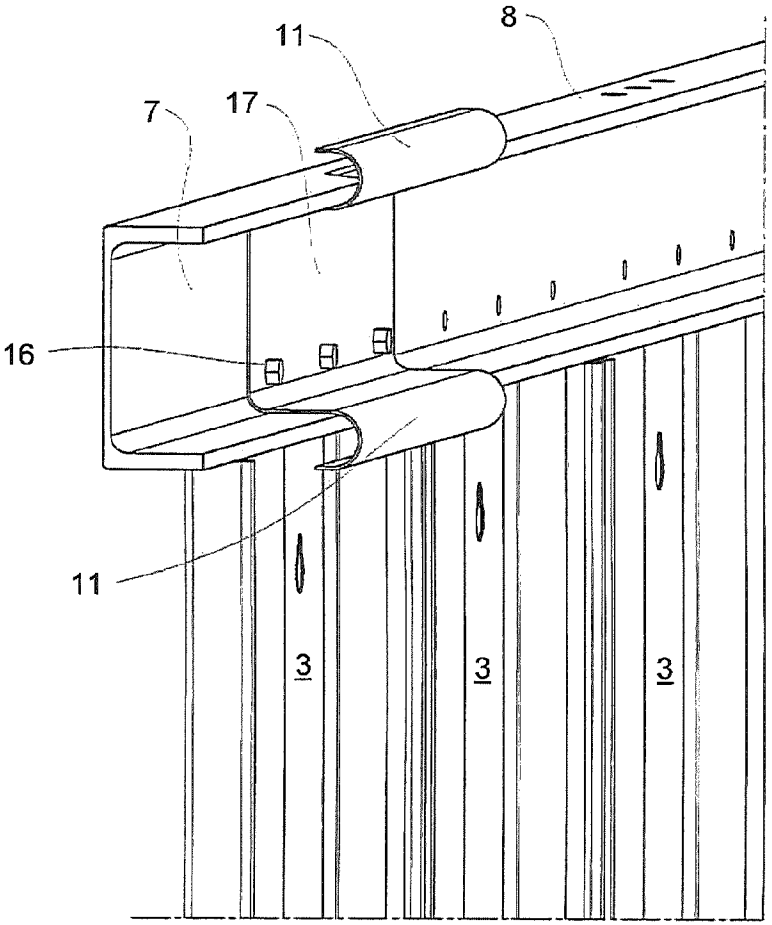
FIG. 6 is a schematic view in perspective partly illustrating an upper part of one collecting electrode plate assembly of the electrostatic precipitator in accordance with an alternative embodiment.

Each collecting electrode plate 3 is suspended and supported from an I-shaped or U-shaped upper support beam 7 disposed at the upper portion, as shown in FIG. 1 and FIG. 6, of the electrostatic precipitator 1. As shown in FIG. 4, the lower end 14 of each of the suspended collecting electrode plates 3 is laterally constrained from movement by fastening to an L-shaped lower support beam 12 disposed in the bottom of the electrostatic precipitator 1.

The collecting electrode plates 3 are shown in the drawings as being of a particular cross section merely for purposes of illustration and not limitation. It is to be understood that the present embodiment contemplates utilizing collecting electrode plates of any of a number of cross-sectional designs with the particular design utilized in any given situation being selected on an individual basis to give optimal precipitation efficiency at the surface of the collecting electrode plates 3.

As best seen in FIG. 4, each of the individual discharge electrode frames 6 is formed of vertical support members 9 and a pair of horizontal support bars 10 assembled together to form the frame. A number of individual discharge electrode wires (not shown) collectively, and in conjunction with the support bar 10 from which the individual electrode wire is supported and suspended, form the discharge electrode frame assembly.

Mounted within each section of the discharge electrode frames 6 are a plurality of vertical discharge electrode wires (not shown) disposed at spaced intervals along the direction of gas flow so as to provide an electrostatic field and corona discharge along the length of the electrostatic precipitator 1. Although any number of discharge electrode wire designs may be utilized, the typical electrode comprises a flat, thin, and rectangular in cross-section strip-like element or a round wire-like element intended to generate a corona discharge evenly distributed along its length. The discharge electrode wire may be helically winded.

In operation, a particular laden gas enters the precipitator casing (not shown) through the inlet thereof and flows through the precipitation chamber to the outlet. In traversing the electrostatic precipitator 1, the particulate laden gas flows between the collecting electrode plates 3 and the discharge electrode wires disposed therebetween. Due to the action of the corona formed at the discharge electrodes and the electrostatic field extending between the discharge electrodes and the collecting plates 3, the particulates within the gas are ionized and migrate to and deposit upon the collecting electrode plates 3.

The electrostatic precipitator 1 is designed in such way that the vertical support members 9 of the discharge electrode assembly 4 passes the grounded collecting electrode support beam 7 in the top of the electrostatic precipitator 1 and the L-shaped lower support beam 12 disposed in the bottom of the electrostatic precipitator 1. The support beam 7 is normally formed of an I-beam or U-beam. In the prior art the I-beam or U-beam has been provided with cut-outs to increase the distance between the discharge electrode assembly and the beam. Presently, a screening device 11 preferably having a metal structure has replaced said cut-outs and thereby a higher voltage can be reached before any spark-over occurs. The electrical screening device 11 having an essentially rounded or arched shape, to increase the curvature of the surface and to withstand any spark-over. The electrical screening device 11 may be integrated with the supporting structure or being attached to the supporting structure to cover the sharp edge of the I-beam, U-beam or L-beam. Preferably, the electrical screening device 11 having a longitudinal shape and being formed of at least a half-pipe arranged with the outer smooth surface facing said vertical support members 9 of the discharge electrode assembly 4. The shape may be made from a standard pipe by cutting a suitable slot adapted to the I-beam, U-beam or L-beam. The radius of the pipe is essentially larger than the thickness of a flange of the I-beam, U-beam or L-beam. As an example, when the flange having a thickness of 8 mm the radius of the screening device 11 is suitably in the interval of 15 to 100 mm, preferably around 20 mm. In an alternative embodiment at least one electrical screening device 11 is integrally connected with a bracket 15 or 17 attached to the supporting structure 8.

As an example, in a high voltage test rig having spacing between the collecting electrodes of 500 mm and previous known cut-outs a voltage of 123 kV at 50 mA was reached before sparking occurred to said cut-outs. With a screening device 11 having a longitudinal shape, as disclosed in the drawings, and designed in shape of at least a half-pipe to cover the cut-outs, a voltage of 150 kV at 85 mA was reached before sparking occurred. However, the sparking occurred between the discharge electrode assembly 4 and the collecting electrode plate assembly 2 of the electrostatic precipitator 1.

Figure 2:
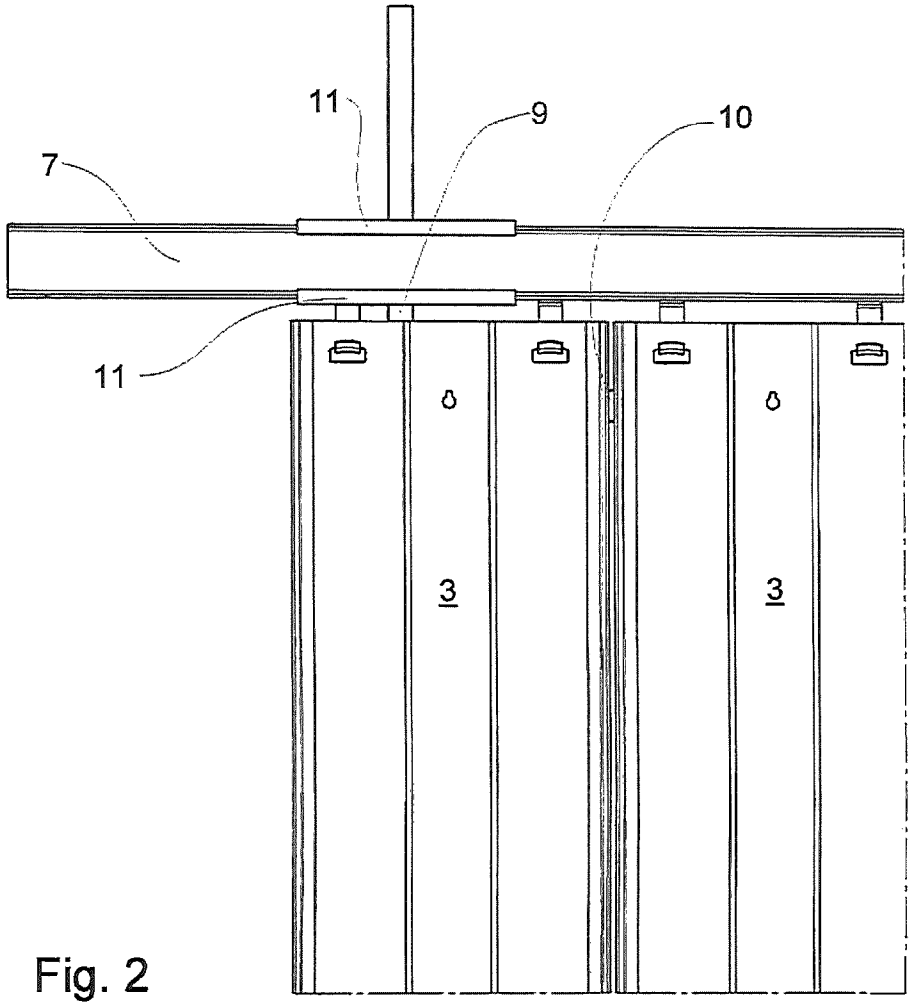
FIG. 2 is a schematic view from the side of the electrostatic precipitator according FIG. 1.
Figure 3:
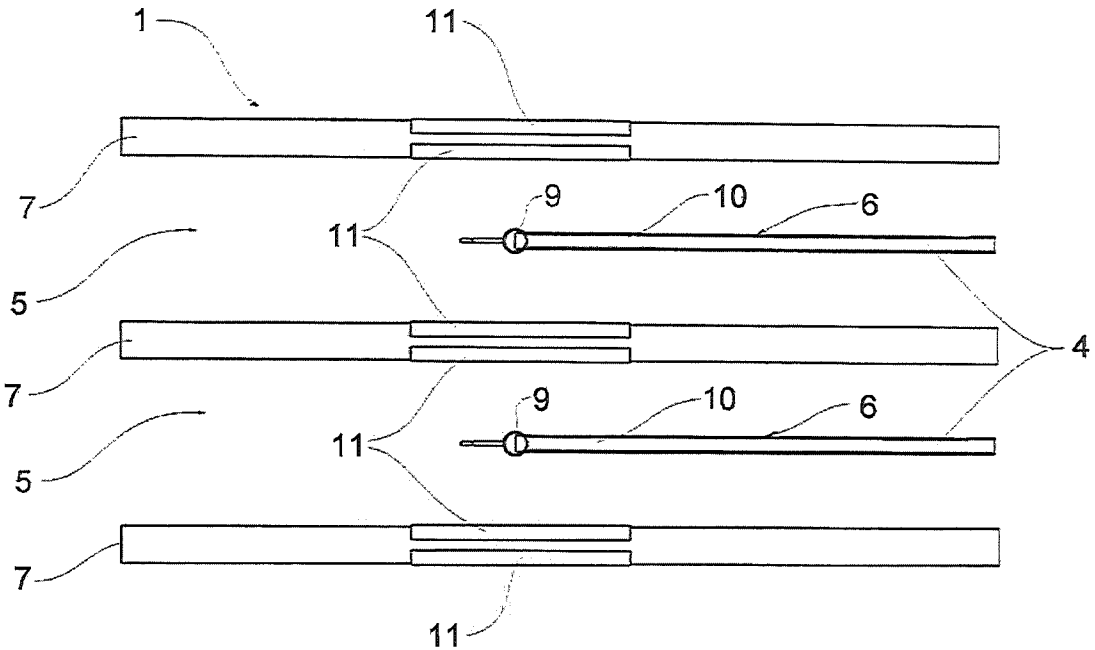
FIG. 3 is a schematic view from above of the electrostatic precipitator according to FIG. 1.

Referring to FIGS. 1 to 3 an intermittently welding of the screening device 11 to the upper support beam 7 is sufficient to fasten the pipe or half-pipe to the I-beam as there are no high rapping accelerating forces in the collecting system suspension beams 7 in the design shown in the drawing. Naturally, the screening device 11 may be completely integrated with the support beam 7 by welding, soldering or fastening in other suitable way e.g. glueing, pressing, clamping etc. An additional advantage with the present design compared with having cut-outs of the I-beam, is that a smaller sized I-beam may be used as the I-beam will not become weakened by such cut-outs.

Figure 5:
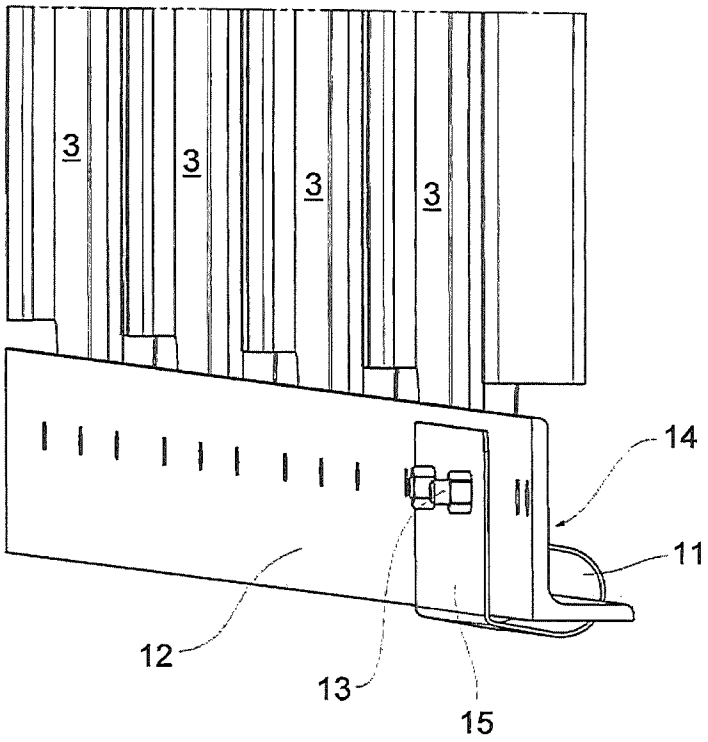
FIG. 5 is a schematic view in perspective from behind, partly illustrating a lower part of one collecting electrode plate assembly of the electrostatic precipitator in accordance with the preferred embodiment.

A similar design with cut-outs in the lower shock bars or lower support beam 12 of the electrostatic precipitator 1 has been used. In the present design, as appear in FIGS. 4 and 5, it is not suitable to fasten the screening device 11 by welding, due to high acceleration of the shock bar or lower support beam 12 during rapping of the electrostatic precipitator 1. Instead the screening device 11 can be fasten by a screw joint 13, and preferably the same screw joint 13 as for the outer collecting electrode plate 3, may be used when attaching to the lower support beam 12. In this embodiment the screening device 11 having a bracket 15 integrally connected to the half-pipe shape of the screening device 11.

Referring to FIG. 6, if rapping is performed at the top of the electrostatic precipitators also this screening device 11 may be attached with the same screw joint 16 that is holding the collecting electrode plate 3 at the top. In the design shown in the drawing the screening device 11 may be provided with a bracket 17 integrally connecting two half-pipes having a longitudinal shape.

To summarize, an electrostatic precipitator 1 having a collecting electrode plate assembly 2, including at least two electrode plates 3 disposed substantially in a parallel to each other in the vertical plane within the electrostatic precipitator

1, forming a space 5 between the collecting electrode plates 3, and a discharge electrode assembly 4 interposed in said spaces 5, wherein the electrode assembly 4 passing at least a supporting structure 8 of the collecting electrode plate assembly 2. The supporting structure 8 is provided with an electrical screening device 11 at least in the area of the supporting structure 8 facing said electrode assembly 4.

While the present invention has been described with reference to a number of preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

The invention claimed is:

1. An electrostatic precipitator comprising:

a collecting electrode plate assembly, including at least two electrode plates disposed substantially in parallel to each other in a vertical plane within the electrostatic precipitator, forming a space between the collecting electrode plates; and a discharge electrode assembly interposed in said spaces with the electrode assembly passing at least a supporting structure of the collecting electrode plate assembly; and an electrical screening device arranged at least in the area of the supporting structure facing said discharge electrode assembly, wherein at least one electrical screening device is integrally connected with a bracket attached to the supporting structure.

2. The electrostatic precipitator according to claim 1, wherein the electrical screening device is of an essentially rounded or arched shape.

3. The electrostatic precipitator according to claim 1, wherein the electrical screening device is integrated with the supporting structure.

4. The electrostatic precipitator according to claim 1, wherein the electrical screening device is attached to the supporting structure.

5. The electrostatic precipitator according to claim 1, wherein the electrical screening device is of a longitudinal shape and formed of at least a half-pipe arranged with an outer surface facing said electrode assembly.

6. The electrostatic precipitator according to claim 1, wherein the electrical screening device is of a longitudinal shape and formed of a half-pipe arranged with an outer surface facing said electrode assembly.

7. The electrostatic precipitator according to claim 2, wherein the rounded or arched shape has a radius between 15 to 100 mm.

8. The electrostatic precipitator according to claim 1, wherein the electrical screening device includes a bracket integrally connecting two half-pipes having a longitudinal shape.

9. The electrostatic precipitator according to claim 1, wherein the electrical screening device is connected to a bracket.

* * * * *